US005608933A

United States Patent [19]

Hanada et al.

[11] Patent Number: 5,608,933

[45] Date of Patent: Mar. 11, 1997

[54] BED HAVING MAT SUPPORT ROLLS ROTATED TO MOVE A MAT FOR BLOOD CIRCULATION OF A PERSON LYING ON THE MAT

[75] Inventors: Hideto Hanada, Aichi-ken; Tadashi Obara, Kasugai; Sigeyuki Takasugi; Nobumasa Imoto, both of Fukuoka; Michiko Nakamura, Onojo; Atushi Minohara, Fukuoka-ken; Norihiko Morinaga, Fukuoka; Hidenori Oshibuchi, Matsuura; Shunnichi Sakaguchi, Tamana; Mitukane Hoshino, Aichi-ken, all of Japan

[73] Assignee: N.H.K Builder Co., Ltd., Aichi-ken, Japan

[21] Appl. No.: 444,575

[22] Filed: May 19, 1995

[51] Int. Cl.[6] ..... A61G 7/00

[52] U.S. Cl. ..... 5/612; 5/613; 5/934; 601/99; 601/115

[58] Field of Search ..... 601/99, 115, 116, 601/122, 126; 5/612, 613, 934, 933, 915

[56] References Cited

U.S. PATENT DOCUMENTS

| | | | |
|---|---|---|---|
| 2,773,498 | 12/1956 | Himmelman | 5/934 X |
| 4,192,296 | 3/1980 | St. Mary | 601/99 |
| 4,267,610 | 5/1981 | Blakeway et al. | 601/122 |
| 5,054,472 | 10/1991 | Stefan | 601/116 |
| 5,109,558 | 5/1992 | Di Blasi | 5/613 |

FOREIGN PATENT DOCUMENTS

| | | | |
|---|---|---|---|
| 2-44543 | 10/1990 | Japan . | |
| 2077580 | 12/1981 | United Kingdom | 5/933 |
| 80002109 | 10/1980 | WIPO | 5/933 |

*Primary Examiner*—Michael F. Trettel
*Attorney, Agent, or Firm*—Oblon, Spivak, McClelland, Maier & Neustadt, P.C.

[57] ABSTRACT

A bed having an array of cylindrical support members supported by a main frame to support a mat, such that the support members are spaced apart from each other in the transverse direction of the bed and such that the support members are rotatable, and a device for rotating the support members in rolling contact with the mat, for changing areas of contact of the mat with the support members to thereby change areas of contact of the user with the mat for promoting blood circulation in a portion of the user in contact with the mat.

22 Claims, 16 Drawing Sheets

BED HAVING MAT SUPPORT ROLLS ROTATED TO MOVE A MAT FOR BLOOD CIRCULATION OF A PERSON LYING ON THE MAT

BACKGROUND OF THE INVENTION

1. Field of the Invention

The present invention relates to a bed adapted to promote blood circulation of a portion of a person such as a human patient or a disabled individual, which is held in contact with a mat on the bed.

2. Discussion of the Related Art

A person confined to a bed tends to be deprived of blood at areas held in contact with a mat on the bed, due to pressure exerted on those areas by the body weight. It is known that the lumbo-sacral area and the great trochanters of a human patient easily suffer from so-called "bed sores" when the patient is confined to a bed for a long time.

In the light of the above problem, there is proposed an improved bed as disclosed in laid-open Publication No. 2-44543 (published 1990) of examined Japanese Patent Application, wherein a mat is supported selectively by two arrays of rigid parallel support beams, namely, a stationary array consisting of stationary beams and a movable array consisting of vertically movable beams. These beams of the two arrays are arranged so as to extend in the longitudinal direction of the bed such that each of the movable beams of the movable array is interposed between the adjacent stationary beams of the stationary array. The movable array is slowly moved up and down between a lower position and an upper position above and below the top plane of the stationary array, so that the mat is supported by the stationary array when the movable array is located below the top plane of the stationary array, and by the movable array when the movable array is located above the top plane of the stationary array.

In the known bed constructed as described above, each of the stationary and movable support beams is a cylindrical support member having a suitable diameter. Since the stationary and movable support beams are arranged alternately in the transverse direction of the bed, the spacing between the adjacent stationary beams or movable beams (placed in the upper position) which support the mat has to be relatively large, for example, two times the diameter of the beams. This relatively large spacing between the adjacent beams which actually support the mat undesirably results in an excessive amount of undulation of the mat, leading to deteriorated comfort with respect to the mat or bed as felt by the patient.

SUMMARY OF THE INVENTION

It is therefore an object of the present invention to provide a bed suitable for promoting blood circulation of a living body, which has a comparatively small spacing between adjacent support members for a mat, for improved comfort of the mat as felt by the patient.

The above object may be achieved according to the principle of the present invention, which provides a bed having a mat on which a patient lies, comprising: (a) a main frame; (b) an array of cylindrical support members supported by the main frame such that the support members are spaced apart from each other at a predetermined spacing interval in a transverse direction of the bed and such that the support members are rotatable about axes thereof, the mat being placed on the array of cylindrical support members; and (c) drive means for rotating the cylindrical support members in rolling contact with the mat, for changing areas of contact of the mat with the support members to thereby change areas of contact of the living body with the mat for promoting blood circulation in a portion of the living body in contact with the mat.

In the bed of the present invention, the support members having a cylindrical shape in transverse cross section are arranged on the main frame in evenly spaced-apart relation with each other in the transverse direction of the bed such that the support members are rotatable about their axes. The mat is placed on the array of the support members, so that the weight of the patient as the user of the bed is supported by the support members through the mat. The support members are rotated by the drive means, in rolling contact with the mat.

The support members can be rotated in rolling contact with the mat provided that the center-to-center distance or spacing pitch of the support members is larger than the diameter of the support members. In other words, the spacing pitch of the support members can be made only slightly larger than the diameter, and the distance between the adjacent areas of contact of the mat with the support members can be accordingly reduced. Therefore, the present arrangement assures a comparatively small degree of undulation of the mat, and improved comfort of the mat as felt by the living body.

In one preferred form of this invention, the bed further comprises: (d) vertical guide members supported by the main frame and engaging the cylindrical support members such that the support members are rotatable about their axes and are vertically movable while being guided by the vertical guide members; and (e) a movable frame supported by the main frame such that the movable frame is movable in the transverse direction and is held in contact with an underside portion of the array of cylindrical support members to thereby support the living body and the mat. In this case, the drive means is adapted to reciprocate the movable frame in the transverse direction at a predetermined operating interval. In the present form of the invention, the living body and the mat are supported directly by the movable frame, which in turn is supported by the main frame. This arrangement permits the drive means to have a simpler construction, unlike an arrangement in which the support members are supported directly by the main frame. Further, the vertical guide members permit the cylindrical support members to be vertically moved, and the weight of the living body easily causes elastic deformation of the cylindrical support members while being sandwiched by and between the mat and the movable frame, particularly when each support member has a cylindrical outer portion made of an elastically deformable soft material. This elastic property of the support members cooperates with the elastic property of the mat to assure an excellent cushioning effect of the bed.

In one advantageous arrangement of the above preferred form of the invention, the invention further comprises: (f) transverse guide members supported by the main frame, for guiding the vertical guide members in the transverse direction; and (g) connecting means for operatively connecting the vertical guide members and the movable frame such that the vertical guide members are moved by a distance smaller than a distance of movement of the movable frame by the drive means. In this arrangement, the rotation axes of the support members are moved in the transverse direction of the bed at a speed lower than the speed of the transverse movement of the movable frame, and the living body on the mat can be held almost stationary.

In another preferred form of the invention, the cylindrical support members are arranged so as to extend in a longitudinal direction of the bed normal to the transverse direction, and the bed further comprises (d) a raiser mechanism which comprises (d-1) a pivot member supported by the main frame pivotally about a pivot axis parallel to the transverse direction, at a predetermined position in the longitudinal direction, the pivot member including a plurality of parallel beams which are connected to each other and which extend in the longitudinal direction, the parallel beams being shorter than the support members, each of the parallel beams being interposed between corresponding adjacent ones of the support members when the pivot member is placed in a horizontal position; and (d-2) means for pivoting the pivot member for adjusting an angle of inclination of the pivot member. This form of the invention facilitates the adjustment of the posture of the patient on the bed, more specifically, the angle of the upper half of the patient with respect to the lower half.

In a further preferred form of the present invention, the cylindrical support members are adapted to have enough flexibility to permit deflection thereof, and the bed further comprises: (d) engaging means supported by the main frame, for engaging with opposite end portions of each of the cylindrical support members; and (e) a movable frame supported by the main frame such that the movable frame is movable in the transverse direction and is held in contact with at least an intermediate portion of the each cylindrical support member to thereby support the living body and the mat, (f) each of the cylindrical support members being deflected due to the flexibility thereof at the intermediate portion in a horizontal plane when the movable frame is moved in the transverse direction by the drive means, whereby the mat is deflected in the horizontal plane. In this form of the invention, each of the cylindrical support members is deflected due to the flexibility thereof at the intermediate portion in a horizontal plane when the movable frame is moved in the transverse direction by the drive means, whereby the mat is deflected in the horizontal plane.

In the above preferred form of the invention, the living body is supported by the flexible support members via the mat. When the movable frame is reciprocated in a transverse direction of the bed by the drive means to rotate the support members in rolling contact with the movable frame, the support members are deflected at their intermediate portions while their opposite end portions are held in engagement with the engaging means supported by the main frame. In other words, the flexible support members are bent or curved in the horizontal plane in the opposite directions of the transverse reciprocating movement of the movable member. Consequently, the mat is similarly bent or curved with the support members alternately in the opposite directions in response to the reciprocating movement of the movable frame.

The above form of the invention is effective to give the patient suitable degrees of movements of the spine and legs when the support members and the mat are repeatedly deflected or curved. Accordingly, the joints of the backbones and leg bones are prevented from remaining in fixed positions for a long time, whereby an otherwise possible problem of difficult movements of the joints can be avoided.

In one advantageous arrangement of the above form of the invention, each cylindrical support member includes a cylindrical outer elastic portion formed of an elastic material such as a sponge or rubber, and the engaging means comprises vertical guide members supported by the main frame and engaging the opposite end portions of the each cylindrical support member such that the support members are rotatable and are vertically movable while being guided by the vertical guide members. In this arrangement, the weight of the living body which acts on the support members through the mat causes the cylindrical outer elastic portion of the support members to be elastically deformed in the vertical direction. However, the vertical guide members permits the support members to remain straight in a horizontal plane.

BRIEF DESCRIPTION OF THE DRAWINGS

The above and optional objects, features, advantages and technical significance of the present invention will be better understood by reading the following detailed description of the presently preferred embodiments, when considered in connection with the accompanying drawings, in which.

DESCRIPTION OF THE PREFERRED EMBODIMENTS

Figure 1:
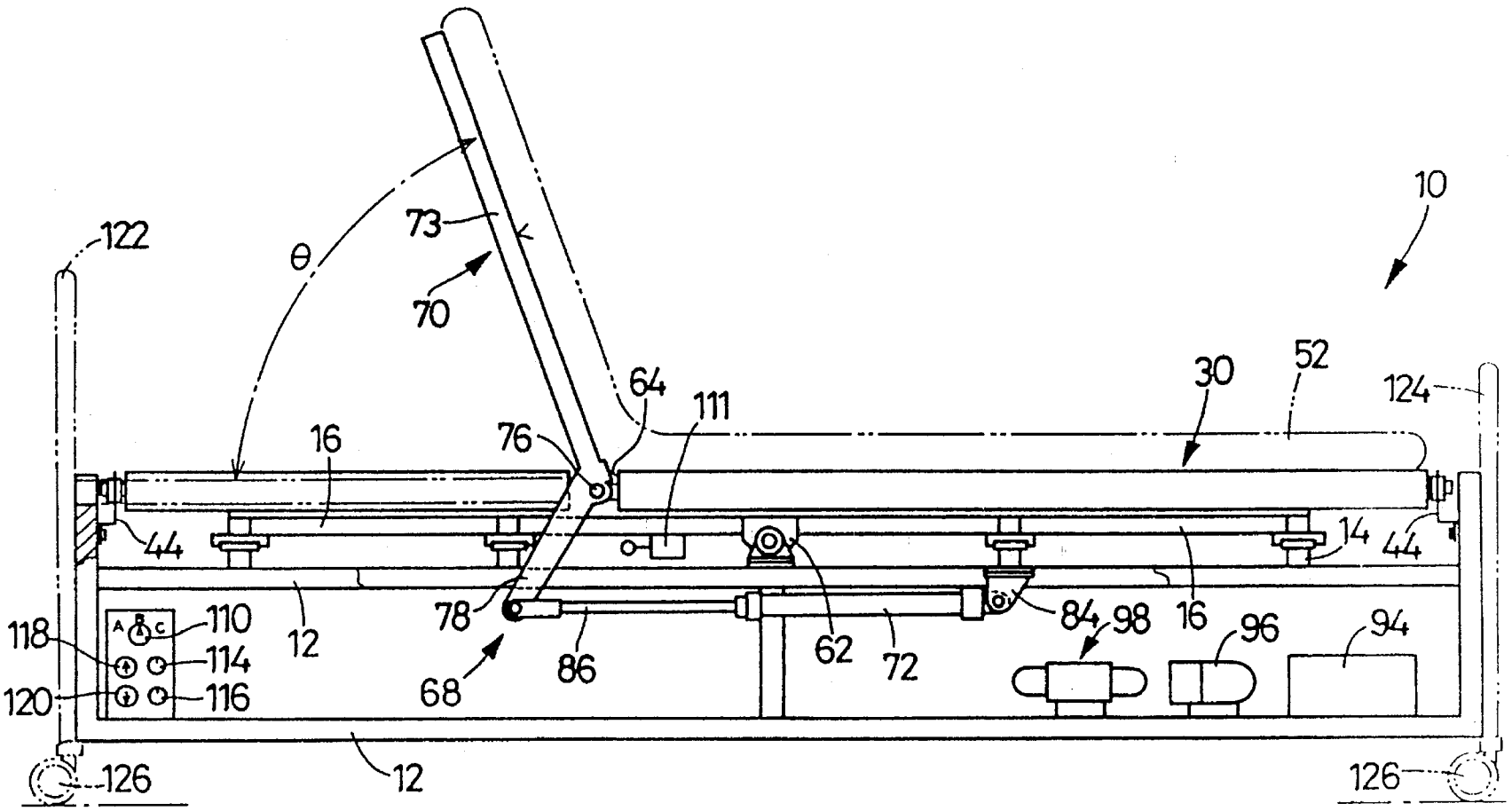
FIG. 1 is a front elevational view of one embodiment of a bed of the present invention.
Figure 2:
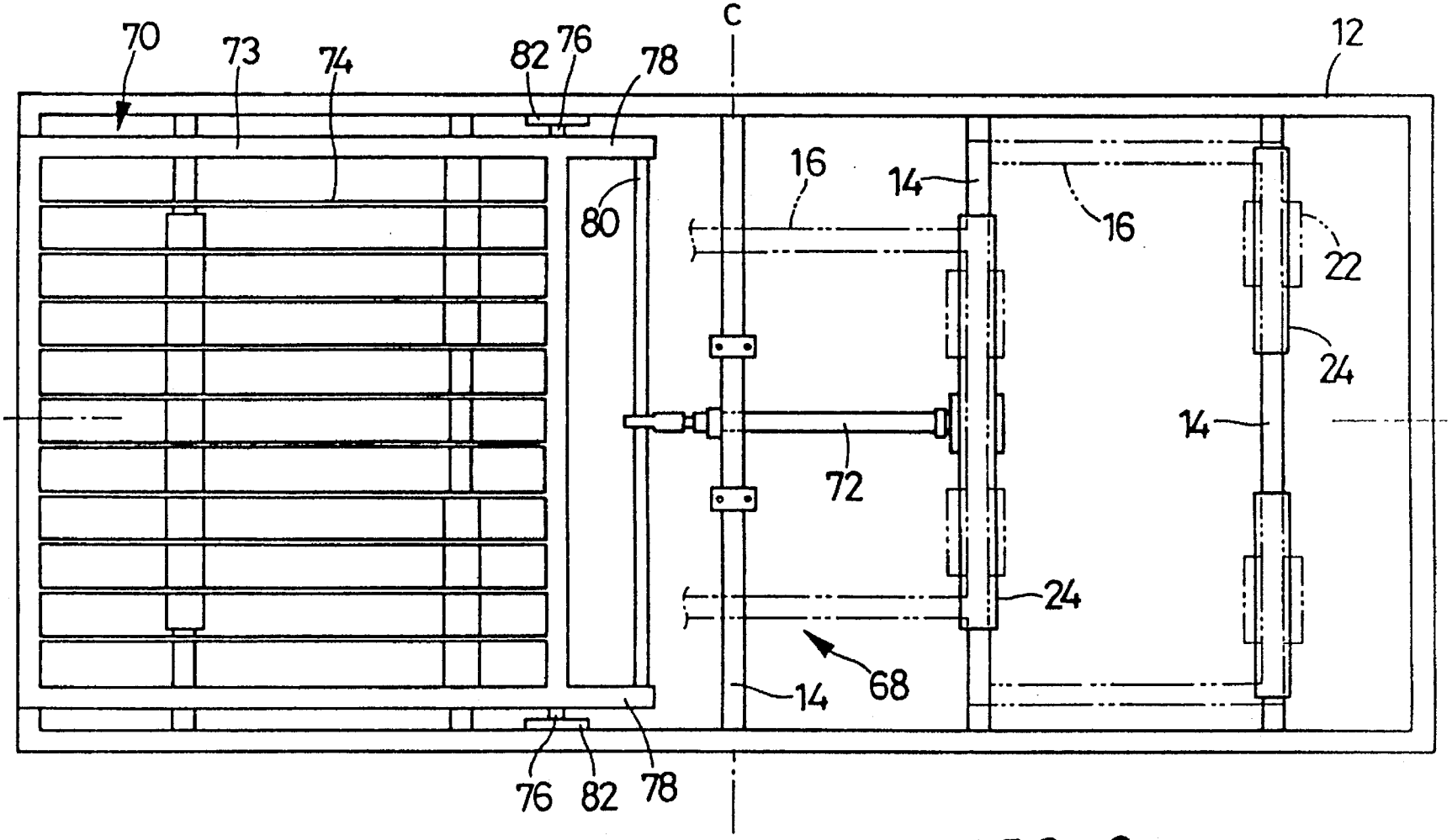
FIG. 2 is a plan view of the bed of FIG. 1, showing in particular a main frame and a raiser mechanism of the bed.

Referring first to the front elevational view of FIG. 1 and the plan view of FIG. 2, a bed 10 constructed according to one embodiment of the present invention has a main frame 12 and a raiser mechanism 68 operatively connected to the main frame 12.

The main frame 12 consists of a generally rectangular framework having a width or transverse dimension smaller than a length or longitudinal dimension, and a height or vertical dimension smaller than the width. On the top surface of the rectangular main frame 12, there are supported five parallel horizontal transverse beams 14 which are spaced apart from each other with suitable spacing in the longitudinal direction of the framework 12, so as to extend in the direction of width of the main frame 12. The transverse beams 14 support a movable frame 16 which consists of three rectangular sections connected to each other. The two sections of the movable frame 16 are indicated in two-dot chain lines in FIG. 2. The three rectangular sections of the movable frame 16 consist of a right section, a left section having the same dimensions as the right section, and an intermediate section which connects the right and left sections and whose middle portion is aligned with a centerline C of the intermediate transverse beam 14 located at the middle of the bed 10 in the longitudinal direction. Namely, the centerline C is the centerline of the bed 10, which defines the right and left sections of the bed (as seen in FIGS. 1 and 2), as indicated in FIG. 2. The movable frame 16 is symmetrical with respect to the centerline C. As described below in detail, the movable frame 16 is movably supported by the transverse beams 14 in the longitudinal direction of the beams 14, that is, in the transverse direction of the bed 10.

Figure 3:
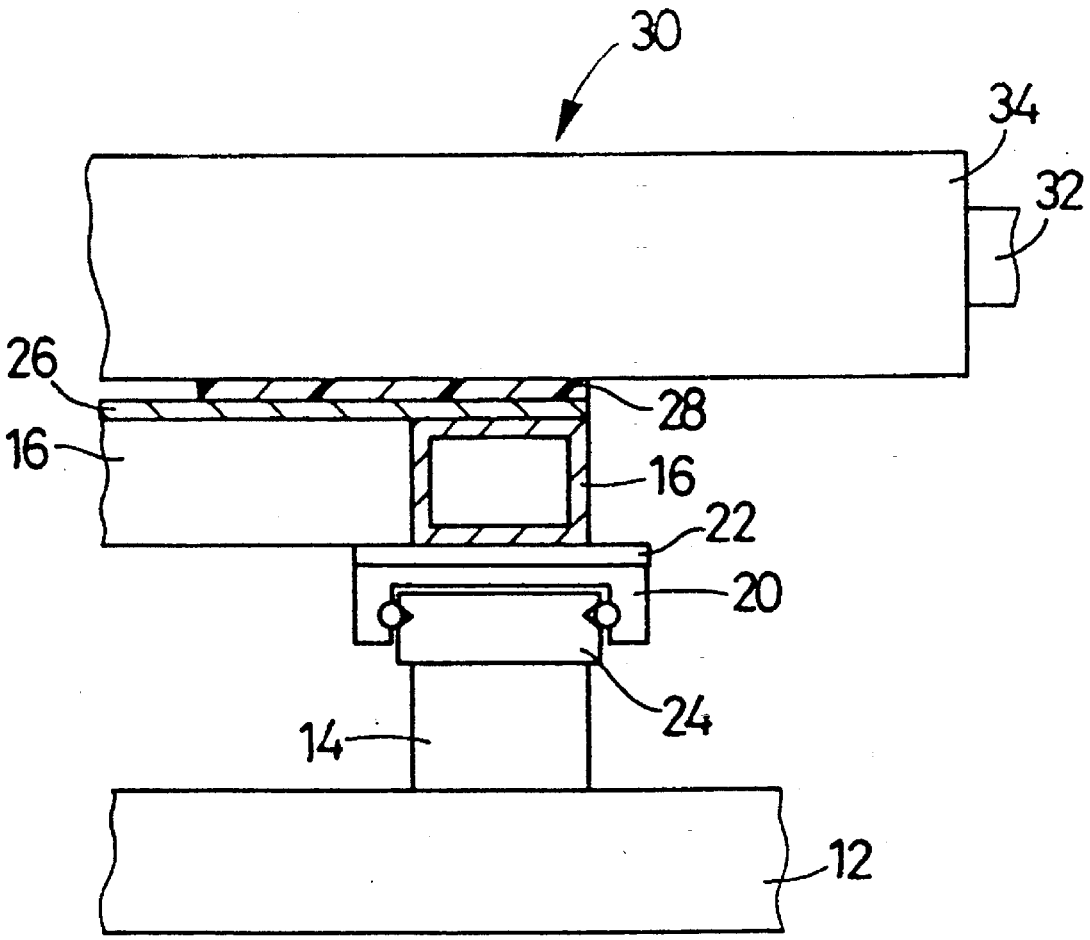
FIG. 3 is an enlarged fragmentary elevational view partly in cross section of the bed, showing one of mat support rolls supported by a movable frame of the bed.

Referring next to FIG. 3, the four outer transverse beams 14 (other than the intermediate beam 14) have respective rails 24 fixed to their top surfaces, and the rails 24 carry respective slide bearings 20 such that the slide bearings 20 are movable on the rails 24 in the longitudinal direction of the rails 24, that is, in the transverse direction of the bed 10, through a succession of recirculating balls. To the top surface of each slide bearing 20, there is fixed a bracket 22 on which the movable frame 16 is fixedly mounted, so that the movable frame 16 is movable relative to the transverse beams 14 via the slide bearings 20 in the transverse direction of the bed 10.

The movable frame 16 has a metal sheet 26 having a relatively small thickness, such as an aluminum sheet. The metal sheet 26 is bonded to the entire area of the top surface of the movable frame 26. A portion of the top surface of the metal sheet 16 is covered by a friction layer 28 made of a rubber material, such that the friction layer 28 covers the entire dimension of the movable frame 16 in the transverse direction of the bed 10. The friction layer 28 is held in frictional contact with an array of mat support rolls 30, which are disposed in spaced-apart relation with each other, so as to extend in the longitudinal direction of the bed 10, as described below more specifically. The mat support rolls 30 function as cylindrical support members for supporting a mat 52 as indicated in FIG. 1.

Each mat support roll 30 consists of a center sleeve 32 made of a metal and having a length slightly smaller than the length of the main frame 12, and a cylindrical outer elastic portion 34 bonded to the outer circumferential surface of the center metal sleeve 32. The outer elastic portion 34 is formed of an elastically deformable soft synthetic resin material such as a soft urethane rubber and a foamed urethane rubber, so that the outer elastic portion 34 functions as a cushioning member. It is desirable that the outer elastic portion 34 have a hardness of HS 20–23 according to the JIS A Standard. The thus constructed mat support rolls 30 are disposed such that their axes of rotation lie in the horizontal plane and such that each roll 30 is rotatably supported about its axis and freely movably in the vertical direction, as described below.

Figure 4:
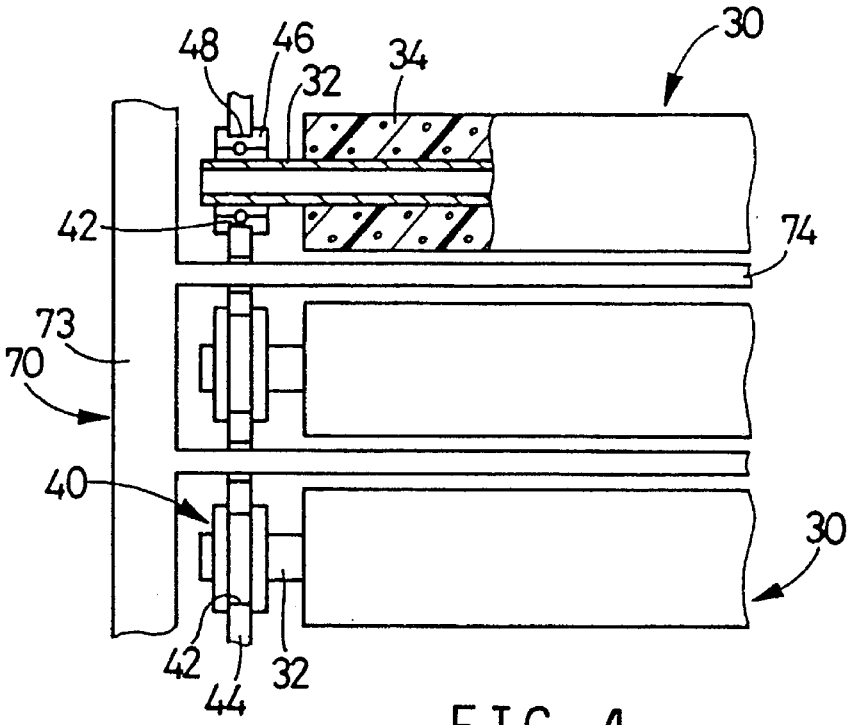
FIG. 4 is an enlarged fragmentary plan view partly in cross section, showing the arrangement of the mat support rolls and a construction of the rolls.
Figure 5:
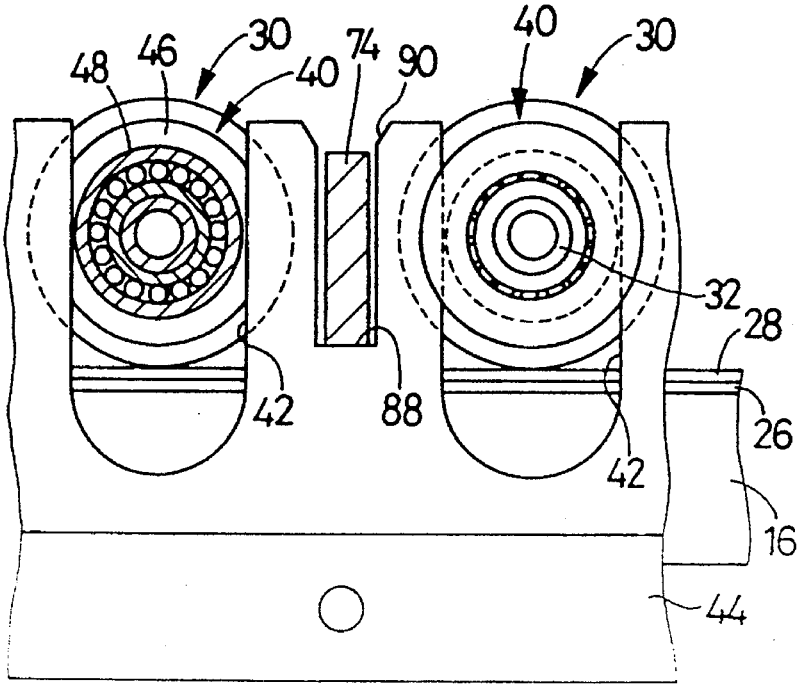
FIG. 5 is an enlarged fragmentary view showing an arrangement of a vertical guide member for the mat support rolls.

As shown in FIGS. 4 and 5, bearings 40 are mounted on the opposite end portions of the center metal sleeve 32 of each roll 30. On the other hand, two vertical guide members 44 are fixedly disposed at the right and left ends of the main frame 12 such that the two guide members 44 are located at the top of the main frame 12 and are opposed to each other, as indicated in FIG. 1. Each vertical guide member 44 has a plurality of U-shaped cutouts 42 corresponding to the respective rolls 30. The cutouts 42 are spaced apart from each other in the transverse direction of the bed 10. Each bearing 40 has an outer race 46 which has an annular groove 48 formed in its outer circumferential surface. The rolls 30 are positioned such that the annular grooves 48 of the bearings 40 engage the U-shaped cutouts 42 of the vertical guide members 44, as indicated in FIGS. 4 and 5, so that the rolls 30 are rotatable about their axes and freely movable in the vertical direction with sliding contact between the grooves 48 and the cutouts 42, while the adjacent rolls 30 maintain a predetermined spacing distance in the transverse direction of the bed 10. The vertical guide members 44 serve as engaging means for engaging with the axially opposite end portions of the rolls 30.

Figure 6:
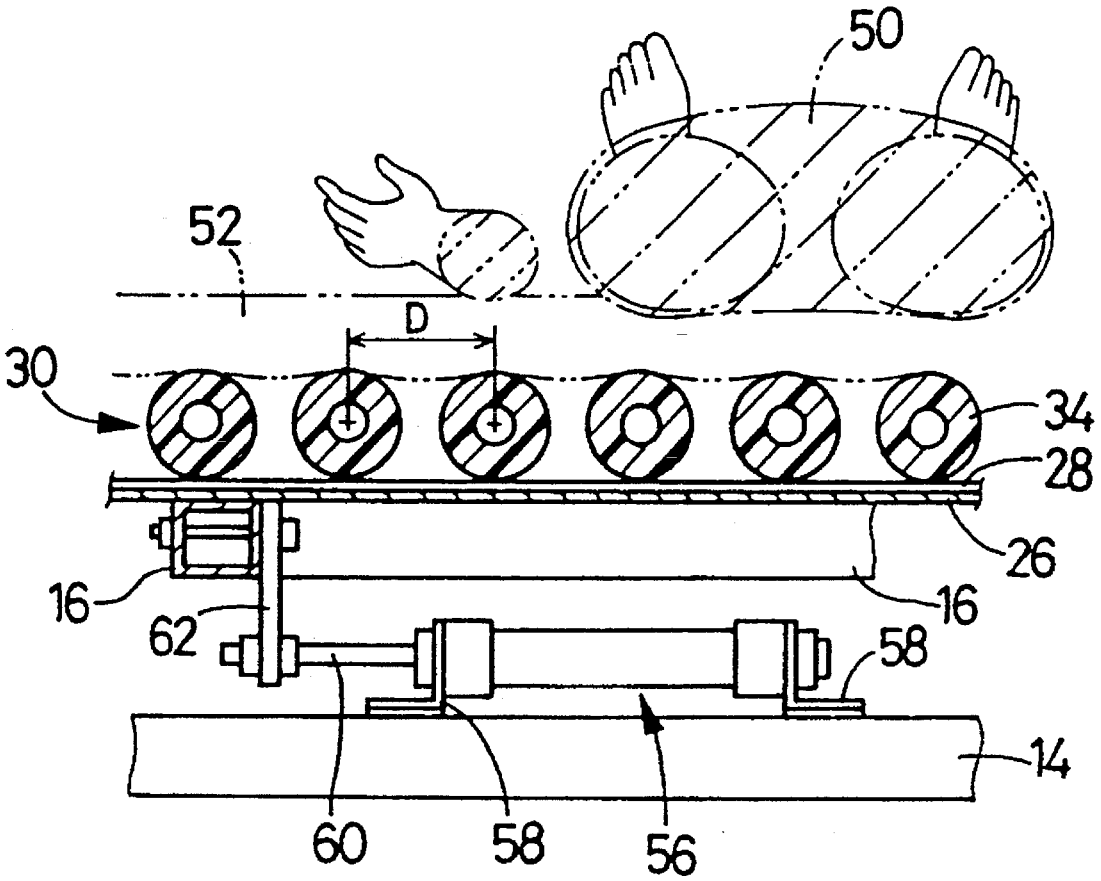
FIG. 6 is an enlarged fragmentary elevational view in transverse cross section of the bed, showing in particular a rolling cylinder connected to the movable frame for rotating the mat support rolls.

Thus, the mat support rolls 30 which are supported directly by the movable frame 16 are eventually supported by the horizontal transverse beams 14 through the movable frame 16, slide bearings 20 and rails 24. As shown in FIGS. 1 and 6, the mat 52 is placed on the array of the rolls 30, and a patient 50 lies on the mat 52.

Each mat support roll 30 has an outside diameter of 60–70 mm. For improved comfort as felt by the patient 50 lying on the mat 52 under pressure due to the own weight, a center-to-center-distance D (spacing pitch) of the rolls 30 is preferably held within a range between 70 mm and 100 mm.

As shown in FIG. 6, a rolling hydraulic cylinder 56 is secured through brackets 58 to the intermediate transverse beam 14 which is located in the middle of the length of the bed 10. The rolling cylinder 56 has a piston rod 60 connected to the movable frame 16 through a bracket 62, so that the movable frame 16 is reciprocated in the horizontal plane and in the transverse direction of the bed 10, when the piston rod 60 is moved between its fully retracted position and fully advanced position. As a result of the reciprocating movements of the movable frame 16, the rolls 30 in layer contact with the friction 28 on the movable frame 16 are rotated in rolling contact with the lower surface of the mat 52. Since the rolls 30 are prevented by the vertical guide members 44 from moving in the transverse direction of the bed 10, the mat 52 is moved in the transverse direction by the rotation of the rolls 30, whereby the areas of the mat 52 in contact with the rolls 30 are shifted in the transverse direction. The operating stroke of the rolling cylinder 56, namely, the distance between the fully retracted and advanced positions of the piston rod 60 is determined to be equal to a value selected within a range between D/2 and D, where "D" represents the center-to-center distance or spacing pitch D of the rolls 30. In other words, the distance of reciprocation of the mat 52 in rolling contact with the rotating rolls 30 is selected within the range between D/2 and D.

Each mat support roll 30 has an annular cutout 64 formed at a portion thereof, which portion is spaced from the left end by a distance equal to about one third of the entire length of the roll 30, as is apparent from FIG. 1. In the presence of the annular cutout 64, the center metal sleeve 32 is almost exposed at that portion of the roll 30. As described below in detail, a pivot-center portion of a pivot member 70 of the raiser mechanism 68 indicated above is positioned or accommodated in the annular cutouts 64 of the rolls 30.

As shown in FIG. 1, the raiser mechanism 68 includes the above-indicated pivot member 70, and a pivoting hydraulic cylinder 72 for pivoting the pivot member 70 for changing the angular position or angle of inclination of the pivot member 70. As shown in FIG. 2, the pivot member 70 includes: an outer frame 73; a plurality of parallel beams 74 extending in the longitudinal direction of the bed 10, between the right and left sides (as seen in FIG. 2) of the outer frame 73; a pair of support shafts 76 which extend outwardly from the outer frame 73 in the transverse direction of the bed 10; a pair of arms 78 which extend from the outer frame 73 in the right direction (as seen FIG. 2); and a connecting rod 80 connecting the arms 78. The outer frame 73 has a width dimension which is smaller than the width dimension of the main frame 12 but is larger than the distance between the two outermost rolls 30 (as measured in the transverse direction of the main frame 12). The pivot member 70 is pivotally supported by bearings 82 fixed to the main frame 12, such that the support shafts 76 are rotatably supported by the bearings 82.

When the outer frame 73 of the pivot member 70 is placed in its horizontal position indicated in two-dot chain line in FIG. 1, the top surfaces of the outer frame 73 and the beams 74 are located slightly below the lower surface of the mat 52 supported by the rolls 30, while the beams 74 are disposed between the rolls 30 as indicated in FIG. 4. The vertical guide member 44 at the left end of the main frame 12 has a plurality of recesses 88 which accommodate the end portions of the beams 74, as shown in FIG. 5. Each recess 88 has a ramp 90 at its upper end, which facilitates the insertion of the beams 74 into the recesses 88.

The pivoting cylinder 72 is connected to a bracket 84 fixed to the transverse beam 14 between the intermediate beam 14 and the rightmost beam 14, as shown in FIGS. 1 and 2, such that the cylinder 72 is pivotable at its end connected to the bracket 84. The cylinder 72 has a piston rod 86 connected to the connecting rod 80 of the pivot member 70, such that the piston rod 86 is pivotable relative to the pivot member 70. The inclination angle 8 of the pivot member 70 can be changed as the piston rod 86 is advanced.

Figure 7:
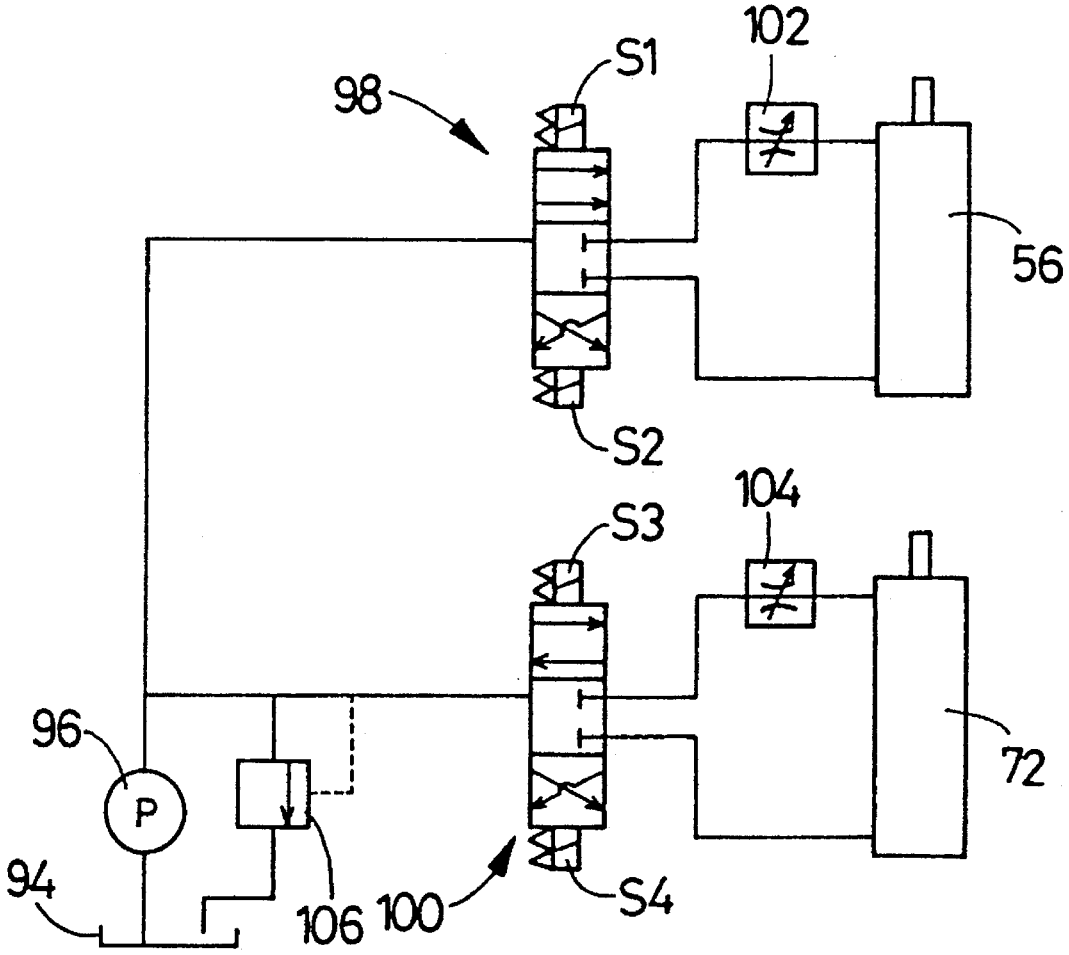
FIG. 7 is a hydraulic control device for activating the rolling cylinder of FIG. 6 and a pivoting cylinder also used in the bed of FIG. 1.

Referring next to FIG. 7, there is shown an example of a hydraulic system for operating and controlling the hydraulic cylinders 56, 72 for rotating the rolls 30 and pivoting the pivot member 70 of the raiser mechanism 68. The hydraulic system includes a hydraulic pump 96 delivers a pressurized oil to a first solenoid-operated control valve 98 for the rolling cylinder 56 and a second solenoid-operated control valve 100 for the pivoting cylinder 72. The delivery pressure of the pump 96 is set by a relief valve 106, which functions to return the oil to an oil reservoir 94 when the delivery pressure exceeds a predetermined upper limit. The control valve 98 is a 3-position valve having two solenoids S1, S2. When these solenoids S1, S2 are both off, the rolling cylinder 56 is held off. When one or the other of the solenoids S1, S2 is turned on, the oil is fed into one or the other of the two oil chambers of the cylinder 56, whereby the piston rod 60 is advanced or retracted depending upon the solenoid S1, S2 which is turned on. Similarly, the control valve 100 is a 3-position valve having two solenoids S3, S4. When these solenoids S3, S4 are both off, the pivoting cylinder 72 is held off. When one or the other of the solenoids S3, S4 is turned on, the oil is fed into one or the other of the two oil chambers of the cylinder 72, whereby the piston rod 86 is advanced or retracted. The operating speeds of the cylinders 56, 72 are adjustable by respective first and second variable flow restrictors 102, 104, which are provided between the valves 98, 100 and the cylinders 56, 72.

Figure 8:
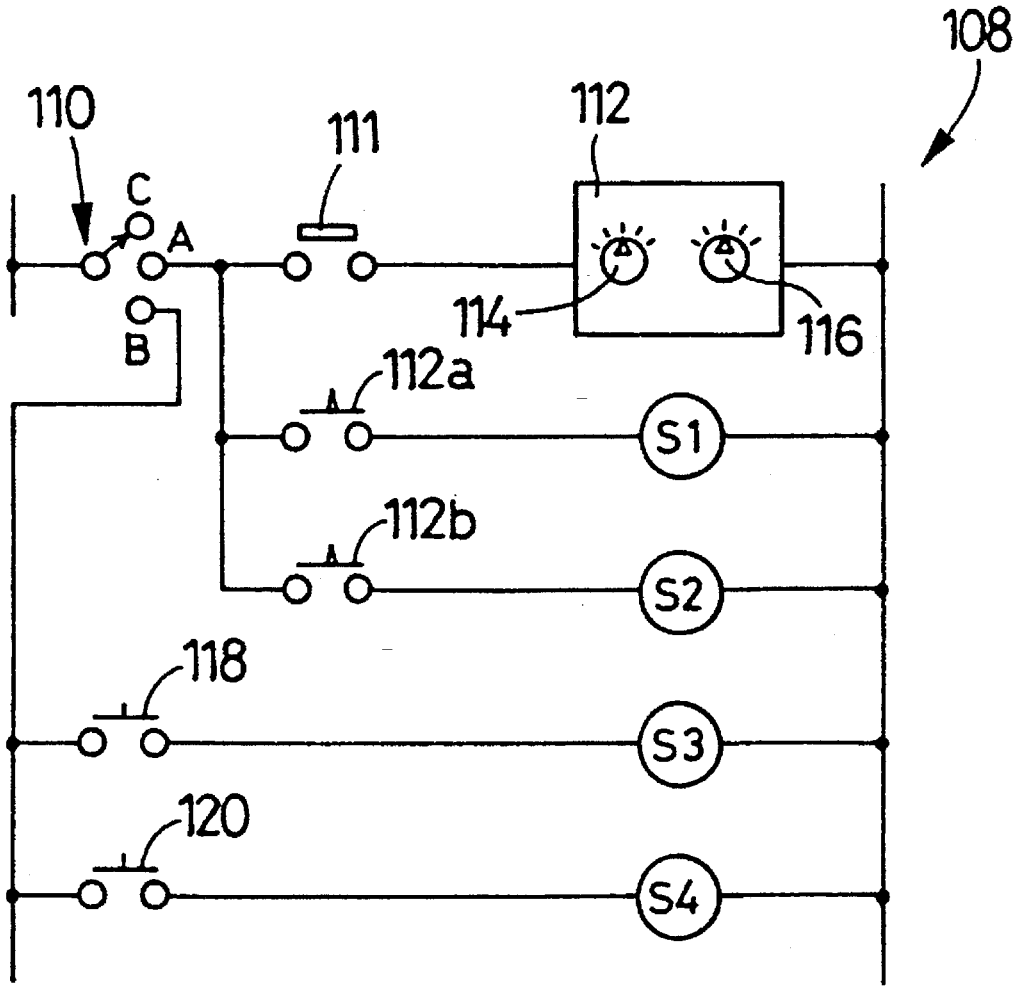
FIG. 8 is an electronic control device for controlling solenoid-operated control valves for the rolling and pivoting cylinders.

The hydraulic system of FIG. 7 is controlled by an electronic control device 108 as shown in FIG. 8 by way of example. The control device 108 includes a MODE selector switch 110, an INTERVAL setter 114, a DURATION setter 116, an UP pushbutton 118 and a DOWN pushbutton 120, which are provided on a control panel provided at the left lower corner of the bed 10, as shown in FIG. 1. The MODE selector switch 110 has three positions A, B, C for selecting a ROLL mode, a RAISE mode and a STOP mode, respectively. The control device 108 also includes a limit switch 111 which is turned on when the pivot member 70 is placed in the horizontal position. For instance, the limit switch 111 is positioned so as to be turned on by one of the arms 78 when the pivot member 70 is brought to the horizontal position.

When the MODE selector switch 110 is placed in the position A for the ROLL mode and the limit switch 111 is on with the pivot member 70 placed in the horizontal position, a timing signal generator 112 is activated. This timing signal generator 112 incorporates the INTERVAL setter 114 and the DURATION setter 116 indicated above. The INTERVAL setter 114 is manually operated to set an operating interval of the rolling cylinder 56, which consists of a reciprocating time of the piston rod 60, and a non-operating time. The DURATION setter 116 is manually operated to set the reciprocating time of the piston rod 60. If the operating interval is set at 2 hours by the INTERVAL setter 114 while the reciprocating time is set at 30 minutes by the DURATION setter 116, the non-operating time is 1 hour and 30 minutes. During the set reciprocating time, the piston rod 60 is alternately advanced and retracted, namely, repeatedly reciprocated between the fully advanced and fully retracted positions, with the solenoids S1, S2 of the control valve 98 being alternately energized, at a predetermined time interval, for example, about two minutes. To this end, output contactors 112*a*, 112*b* are alternately closed to alternately energize the solenoids S1, S2. The INTERVAL and DURATION setters 114, 116 permit the operating interval and reciprocating time to be set within a range between zero and several hours. As a result, the mat support rolls 30 are rotated in opposite directions, alternately at the predetermined time interval (e.g., two minutes as indicated above). The advancing time of the piston rod 60 for rotating the rolls 30 in one direction is substantially to the retracting time for rotating the rolls 30 in the other direction. These advancing and retracting time can be adjusted by the first variable flow restrictor 102. For example, the advancing and retracting time is set to be about 15 seconds.

When the MODE selector switch 110 is placed in the position B for selecting the RAISE mode, the timing signal generator 112 is disabled to inhibit the operation of the rolling cylinder 56, that is, inhibit the rotation of the rolls 30. If the UP pushbutton 118 or DOWN pushbutton 120 is depressed in this condition, the solenoid S3 or S4 is energized. The piston rod 86 of the cylinder 72 is advanced to increase the inclination angle 8 of the pivot member 70 as long as the solenoid S3 is held energized. Conversely, the piston rod 86 is retracted to reduce the inclination angle θ as long as the solenoid S4 is held energized. The pivoting speed of the pivot member 70 is adjustable by the second variable flow restrictor 104.

When the MODE selector switch 110 is placed in the position C for the STOP mode, the UP and DOWN pushbuttons 118, 120 as well as the timing signal generator 112 are disabled, to inhibit the operations of the rolling cylinder 56 and the pivoting cylinder 72, namely, to inhibit the rotation of the rolls 30 and the pivoting movement of the pivot member 70.

The bed 10 is provided with handles 122, 124 at its longitudinal ends, and four wheels 126 at the four corners of the main frame 12, which facilitate the transportation of the bed 10.

In the present bed 10 constructed as described above, the cylindrical mat support members in the form of the mat support rolls 30 are disposed on the main frame 12 in parallel with each other with the predetermined spacing distance or center-to-center distance D, and the weight of the living body 50 is supported by these rolls 30 through the mat 52. The rolls 30 can be rotated by the rolling cylinder 56, in rolling contact with the mat 52, whereby the areas of the mat 52 held in contact with the rolls 30 are changed at a desired interval. This arrangement is effective to promote the blood circulation of the living body 50 at areas thereof in contact with the mat 52 under pressure due to the weight. Thus, the rotation of the mat support rolls 30 gives the living body 50 a desirable massaging effect, which prevents mat sores of the living body 50 even if the living body 50 is confined to the bed 10 for a long time.

In the present embodiment in which the rolls 30 are rotated in rolling contact with the mat 52, the rolls 30 can be arranged with the center-to-center distance D being only slightly larger than their diameter, and the distance between the adjacent areas of the mat 52 supported by the adjacent rolls 30 can be accordingly reduced. This makes it possible to prevent excessive undulation of the mat 52, and assures improved comfort of the mat 52 as felt by the living body 50 lying on the mat 52.

Further, the vertical guide members 44 permit the rolls 30 to be vertically moved, and the weight of the living body 50 easily causes elastic deformation of the cylindrical outer elastic portion 34 of the rolls 30 while being sandwiched by and between the mat 52 and the movable frame 16. This elastic property of the rolls 30 cooperates with the elastic property of the mat 52 to assure an excellent cushioning effect of the bed 10.

The present embodiment is also adapted to permit automatic adjustment of the inclination angle θ of the pivot member 70 of the raiser mechanism 68 by simply operating the UP or DOWN pushbutton 118, 120, so that the upper half of the living body 50 can be readily raised to take a desired posture.

In the present bed 10, the rolls 30 are permitted to be rotated only when the pivot member 70 is placed in its horizontal position in which the outer frame 73 and beams 74 are spaced from the rolls 30 and the mat 52. This arrangement prevents otherwise possible distortion or deflection of the mat 52 which would occur if the rolls 30 were rotated when the pivot member 70 is apart from its horizontal position.

Referring next to FIGS. 9–15, there will be described a bed 128 constructed according to a second embodiment of this invention. The same reference numerals as used in the first embodiment will be used in the second embodiment, to identify the functionally corresponding components, which will not be described to prevent redundancy of description.

Figure 9:
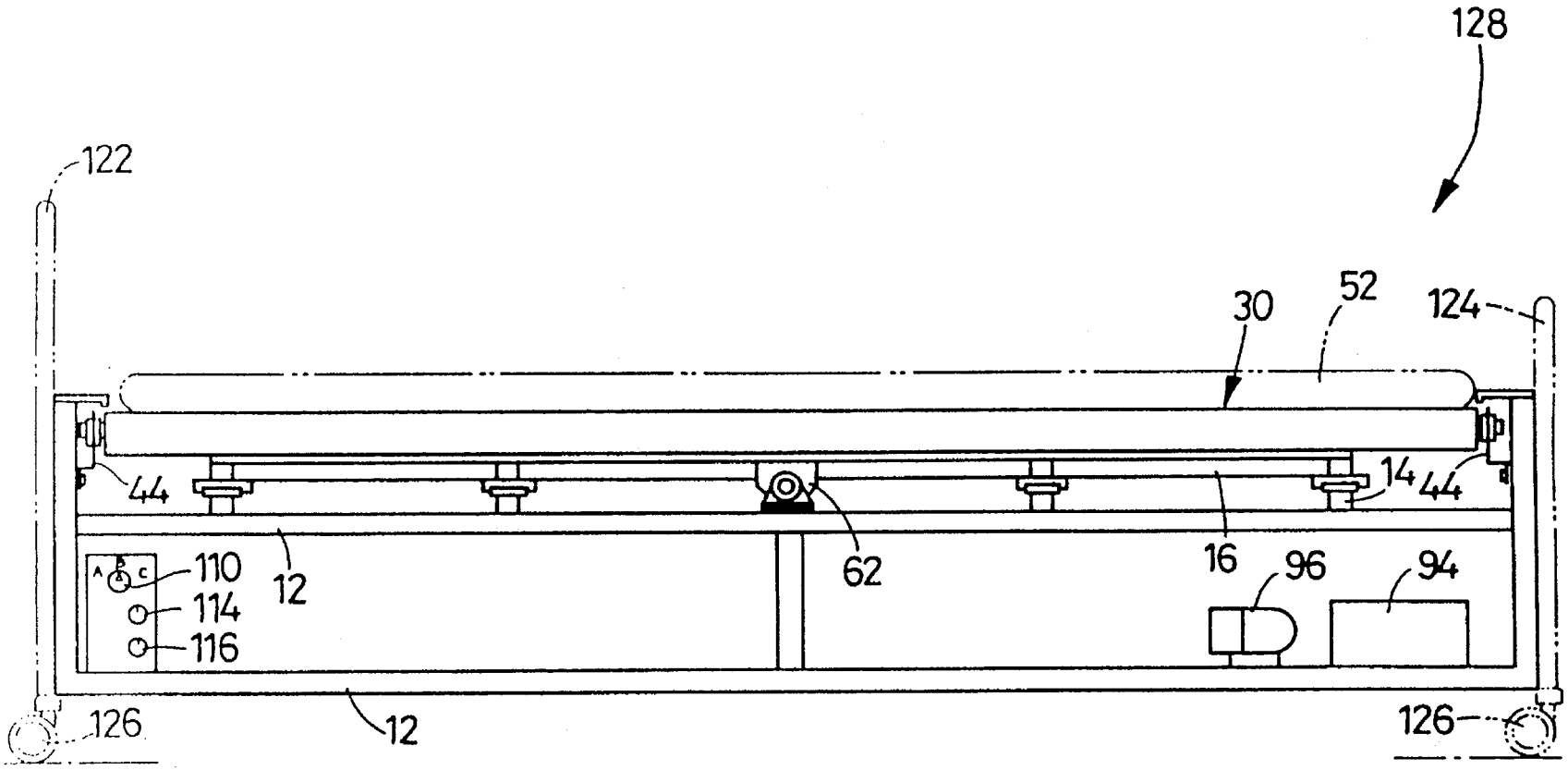
FIGS. 9, 10, 11 and 12 are views corresponding to those of FIGS. 1, 2, 7 and 8, respectively, showing a second embodiment of this invention.
Figure 10:
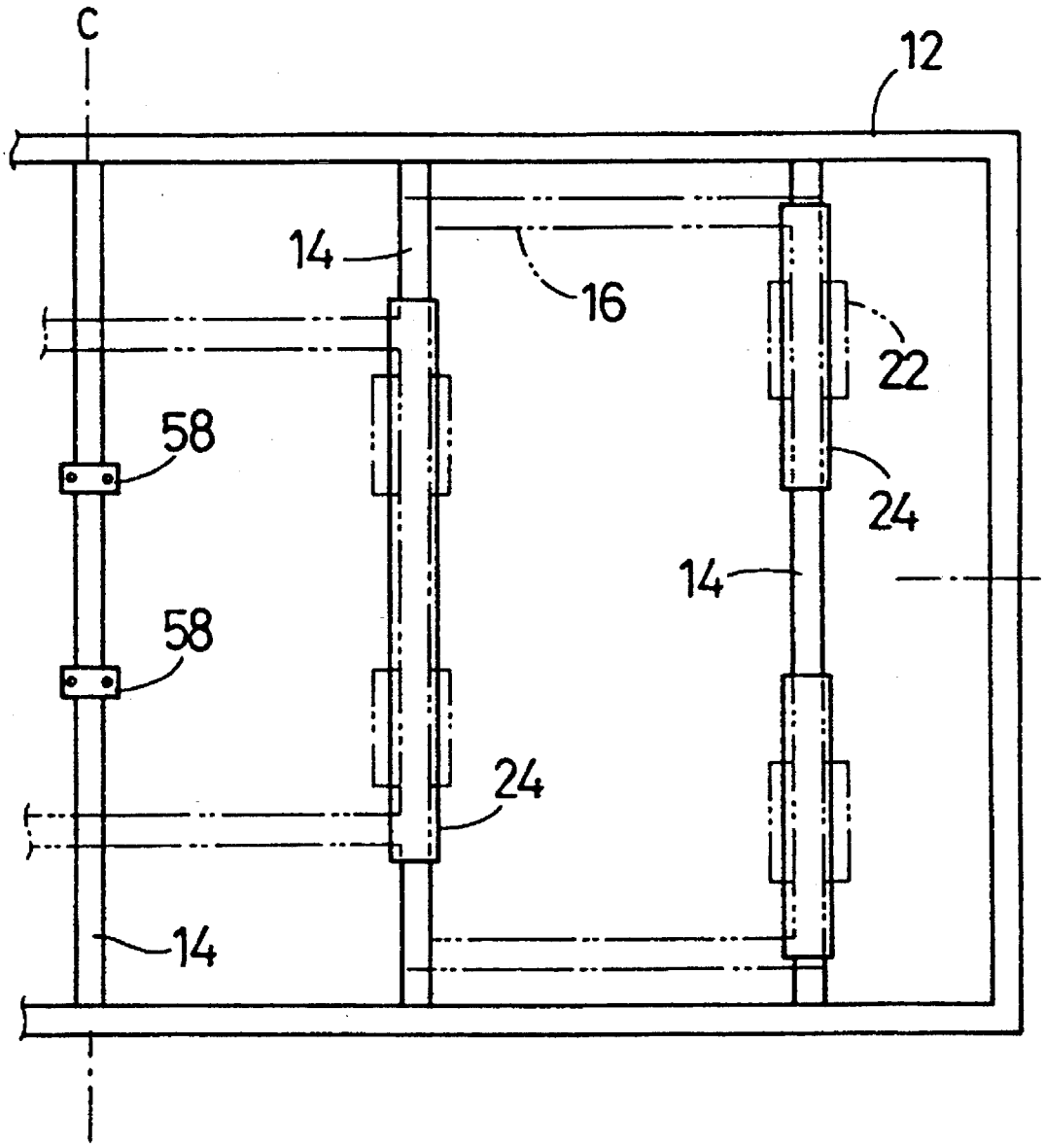
Figure 11:
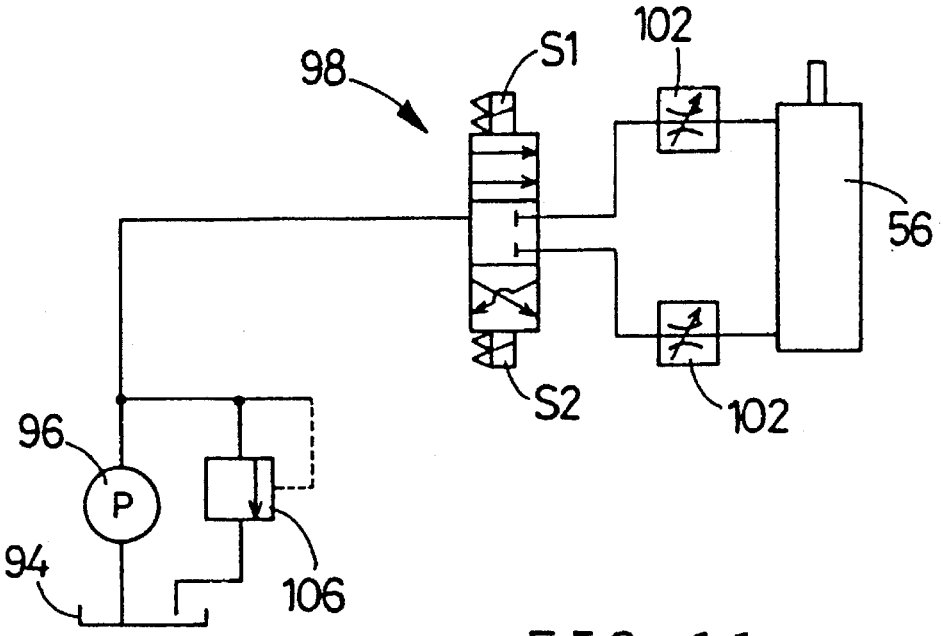
Figure 12:
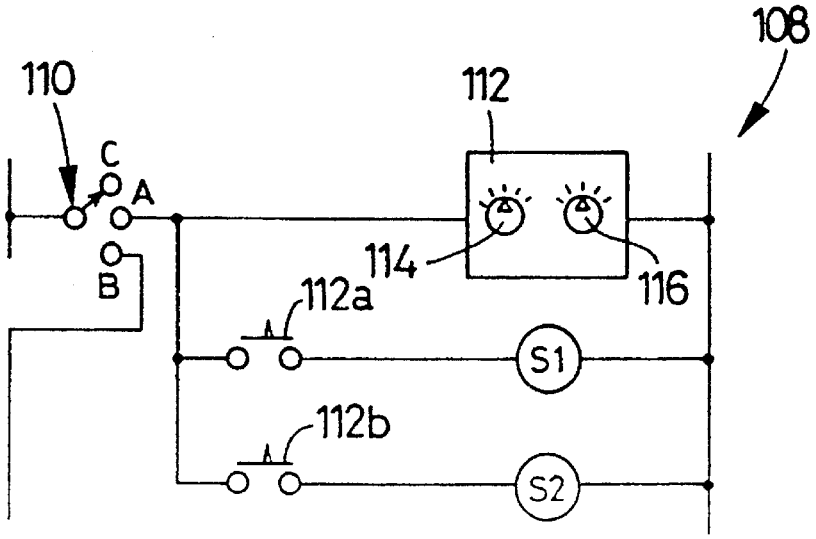

The bed 128 of the present second embodiment is different from the bed 10 of the first embodiment, in that the bed 128 is not provided with the raiser mechanism 68, as indicated in FIGS. 9 and 10, and does not have the pivoting cylinder 72 and the corresponding portions of the hydraulic system and electronic control device for operating and controlling the pivoting cylinder 72, as indicated in FIGS. 11 and 12.

Figure 13:
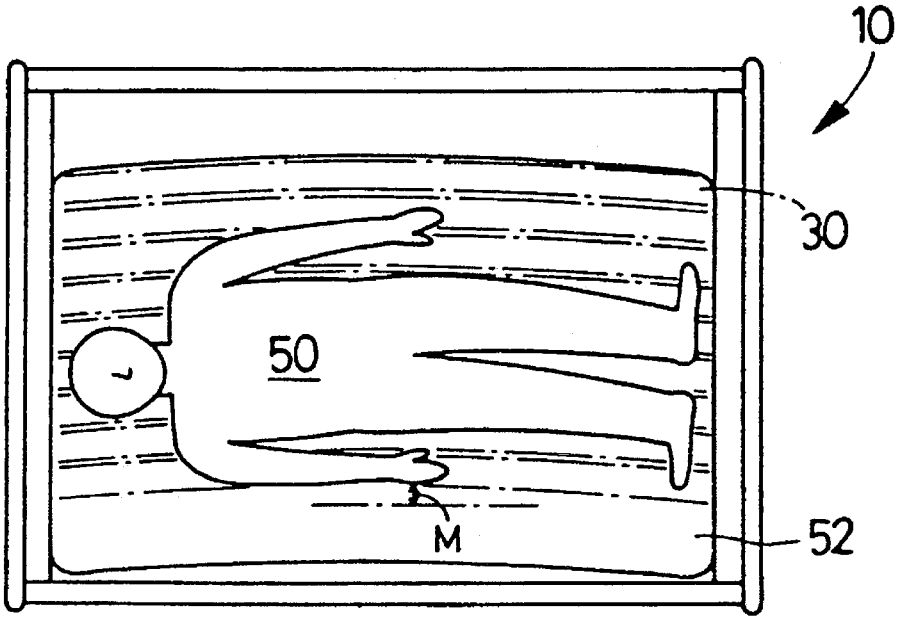
FIG. 13 is a view indicating a state of a mat on the bed of FIGS. 9–12, when the piston rod of the rolling cylinder is placed in its fully advanced position.
Figure 15:
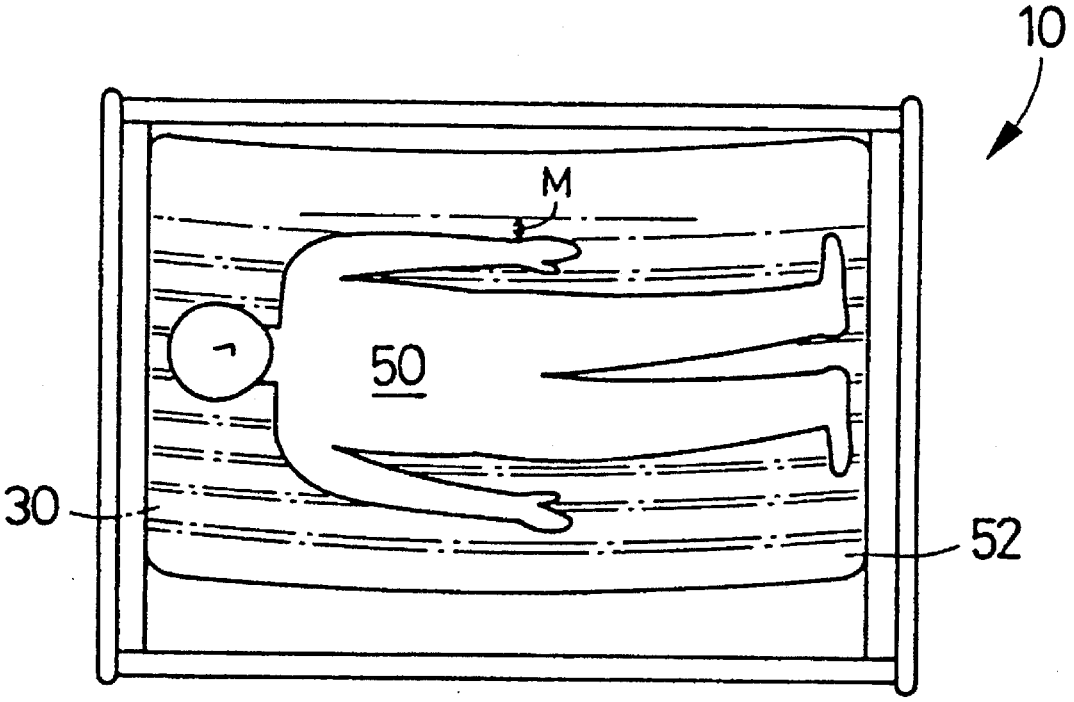
FIG. 15 is a view indicating a state of the map when the piston rod of the rolling cylinder is placed in its fully retracted position.

Further, the rolls 30 are adapted to easily undergo elastic deflection, bending or curving as indicated in FIGS. 13 and 15 when the movable frame 16 is reciprocated to rotate the rolls 30 in rolling contact with the mat 52 while the living body 50 lies on the mat 52. In particular, the center sleeve 32 of each roll 30 consists of a metal tubing such as an aluminum or iron tubing which has a relatively small wall thickness of about 1 mm, to give the roll 30 a sufficiently high degree of flexibility. The cylindrical outer elastic portion 34 is made of an elastically deformable synthetic resin material as described above with respect to the bed 10. The roll 30 should be flexible enough to permit elastic deflection or bending as expressed by a maximum of about 5 cm displacement, preferably about 1–3 cm displacement in the transverse direction of the bed 128. This displacement is indicated at "M" in FIGS. 13 and 15.

Figure 14:
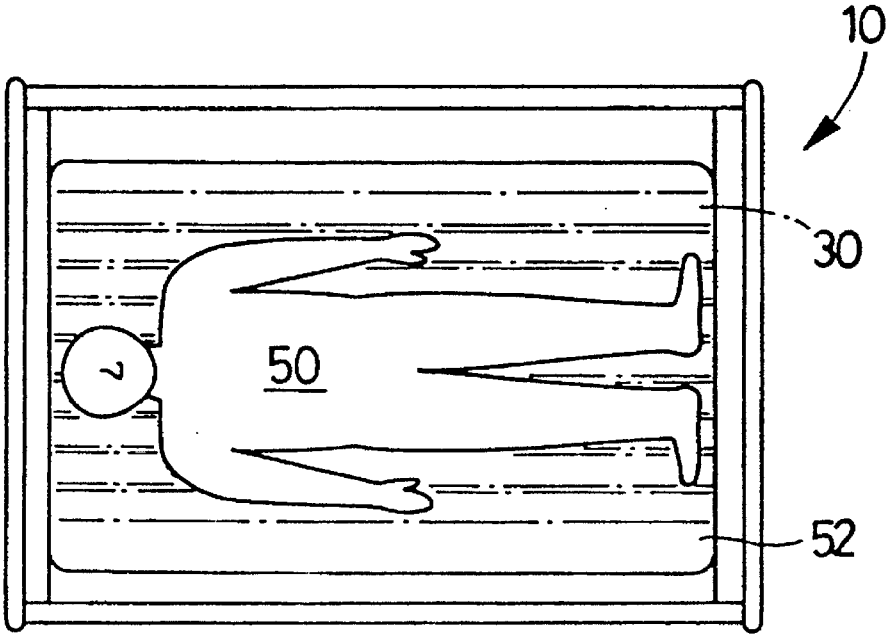
FIG. 14 is a view indicating a state of the mat when the piston rod of the rolling cylinder is placed in its intermediate position.

In the bed 128 according to the present second embodiment, when the movable frame 16 is reciprocated to rotate the flexible rolls 30 in rolling contact with the mat 52, the rolls 30 tend to move together with the movable frame 16, due to a resistance to a rotating motion of the rolls 30, which appears to be produced by elastic deformation of the transverse cross sectional shape of the rolls 30 under the pressure due to the weights of the living body 50 and mat 52. On the other hand, the rolls 30 are prevented from moving by the vertical guide members 44 fixed to the main frame 12. Consequently, the rolls 30 undergo elastic deflection or bending with the transverse displacement distance M of about a few centimeters, at their intermediate or middle portions. When the force transmitted from the movable frame 16 to the rolls 30 through the friction layer 28 exceeds the rotation resistance of the rolls 30, the rolls 30 begin to be rotated while they are more or less elastically deflected, bent or curved. The deflection or bending of the rolls 30 occurs alternately in the opposite directions depending upon the direction in which the movable frame 16 is moved in the transverse direction of the bed 128. FIGS. 13, 14 and 15 correspond to the fully advanced position, intermediate position and fully retracted position of the piston rod 60 of the rolling cylinder 56. As indicated in these figures, the mat 52 is also deformed, deflected or bent with the roll 30, whereby the patient 50 is accordingly deflected at the spine and legs, at the operating interval of the cylinder 56. Consequently, the patient 50 kept on the bed 128 is given a suitable movement, which effectively prevents the joints of the backbones and leg bones from remaining in fixed positions for a long time, and thereby prevents an otherwise possible problem of difficult movements of the joints.

Figure 16:
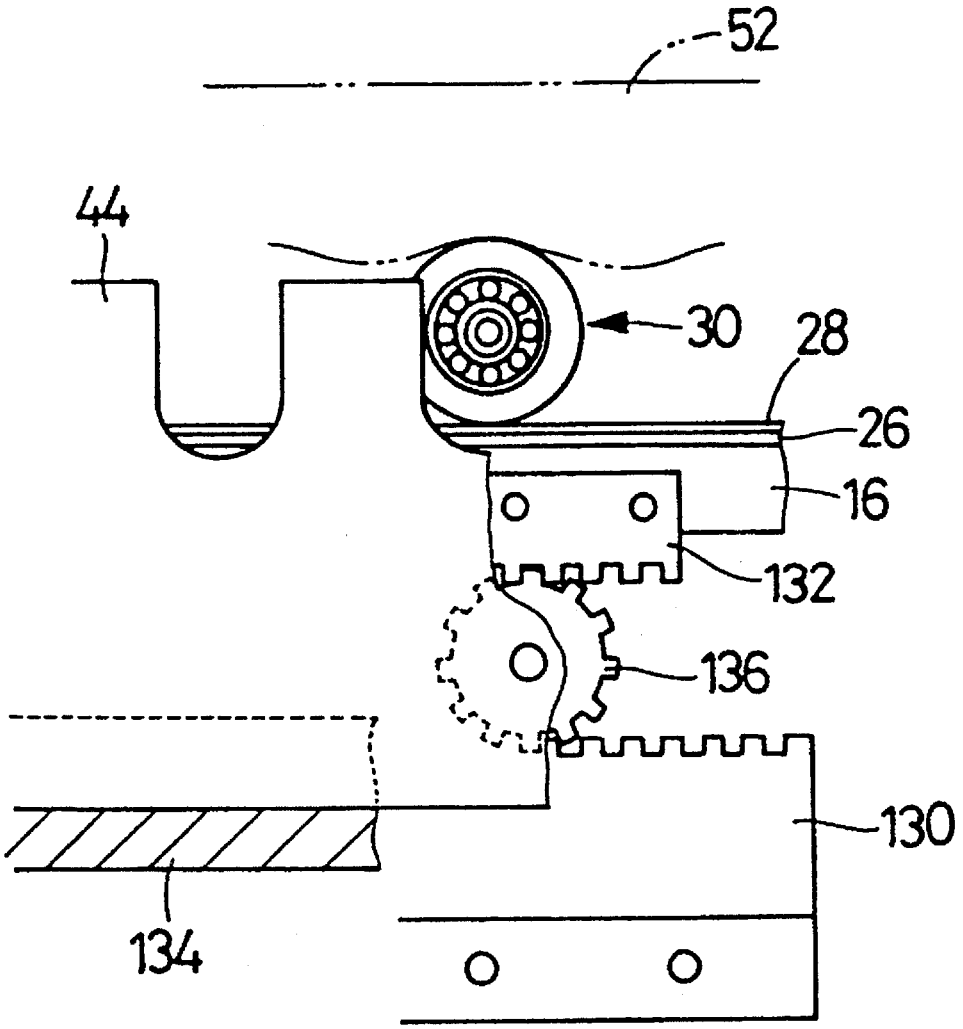
FIG. 16 is a view corresponding to that of FIG. 5, illustrating a third embodiment of the invention.

Reference is now made to FIG. 16, which shows a third embodiment of the invention in the form of a modification of the bed 128 of FIGS. 9–12 without the raiser mechanism 68. FIG. 16 is a view corresponding to that of FIG. 5.

In this embodiment, a stationary rack 130 is fixed to the main frame 12 such that the toothed top surface lies in the horizontal plane. Further, a movable rack 132 is fixed to the end portion of the movable frame 16, such that the movable rack 132 is parallel and aligned with the stationary rack 130. The vertical guide members 44 which engage with the opposite end portions of the rolls 30 through the bearings 40 are supported by transverse guide members 134 such that the vertical guide members 44 are movable in the transverse direction of the bed 128. The vertical guide members 44 carry pinions 136 engaging the stationary and movable racks 130, 132. The pinions 136 are supported rotatably about their axes. Each pinion 136 has a pitch circle having substantially the same diameter as the rolls 30. Alternatively, the pitch circle of the pinions 136 is made equal to the effective outside diameter of the rolls 30, which is determined with the elastic deformation of the outer elastic portion 34 taken into account.

In the present third embodiment, the rotation of the rolls 30 in rolling contact with the movable frame 16 and the mat 52 causes the rotation of the pinions 136, which in turn causes the vertical guide members 44 to move in the transverse direction of the bed 128 by a distance equal to a half of the distance of movement of the movable frame 16, whereby the mat 52 remains substantially stationary, whereby the living body 50 remains substantially stationary during rotation of the rolls 30, and does not feel unsteady.

In the above embodiments, the pump 96 and the solenoid-operated control valves 98, 100 are used to activate the rolling cylinder 56 and the pivoting cylinder 62 (in the first embodiment only). However, an electric motor or motors may be used to activate the cylinder 56, or the cylinders 56 and 72.

Figure 17:
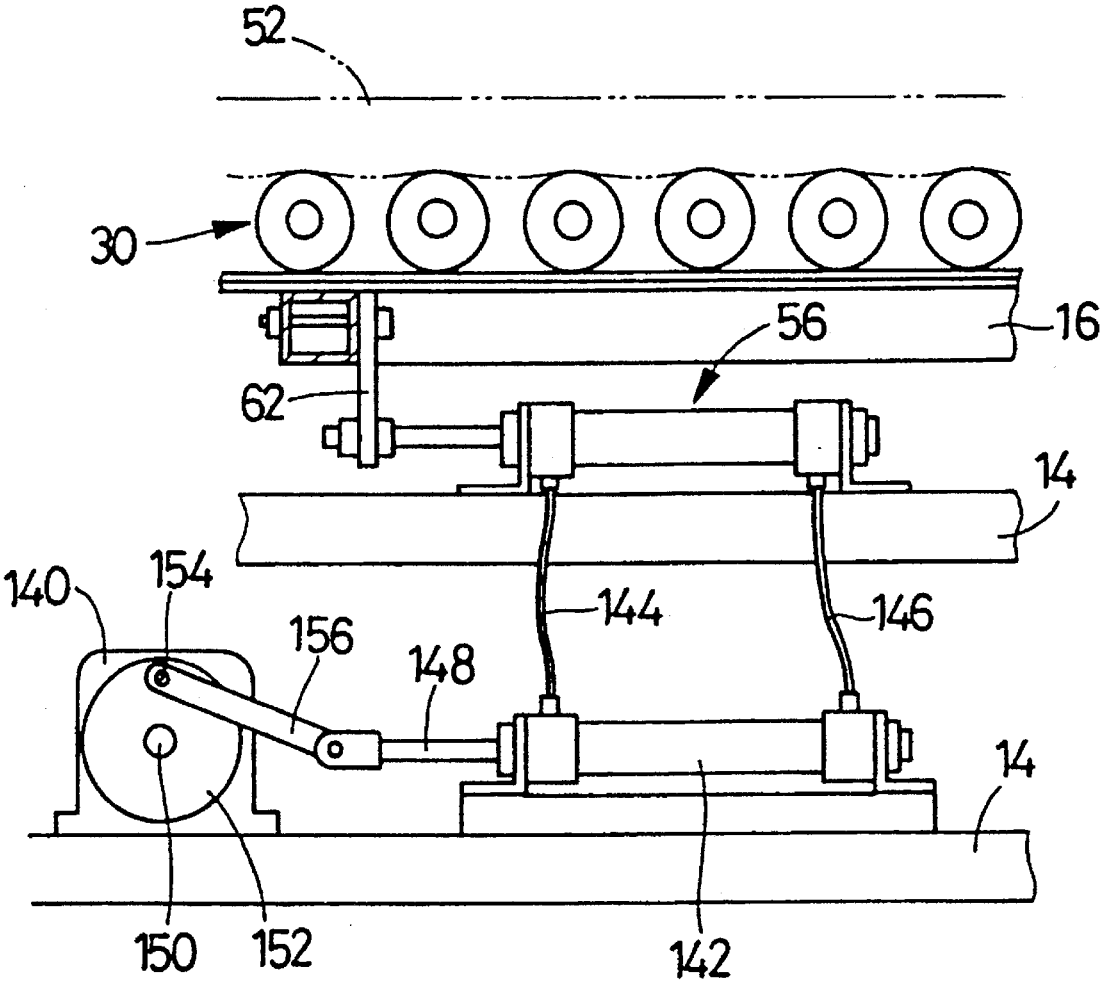
FIG. 17 is a view corresponding to that of FIG. 6, illustrating a fourth embodiment of the invention.

FIG. 17 shows a fourth embodiment of the present invention, in which an electric motor 140 equipped with a speed reducer is used to activate the rolling cylinder 56 to rotate the rolls 30. The motor 140 has an output shaft 150, and a disc 152 fixed to the output shaft 150. The disc 152 has a pin 154 which is connected to a piston rod 148 of a control cylinder 142 through a connecting arm 156. The control cylinder 142 has two oil chambers communicating with the respective oil chambers of the rolling cylinder 56 through respective hoses 144, 146. The electric motor 140 is operated only when the rolling cylinder 56 is activated to rotate the rolls 30. Therefore, the fourth embodiment assures quiet environment of the bed 10, 128. In this respect, the pump 96 used in the hydraulic system of FIG. 7 should desirably be kept operated to maintain the hydraulic pressure at the desired level for intermittent operation of the cylinder 56.

An arrangement similar to that of FIG. 17 is applicable to the pivoting cylinder 72 of the raiser mechanism 68.

The rolls 30 and/or the pivot member 70 may be directly operated by an electric motor or motors, without using hydraulic cylinders.

Figure 18:
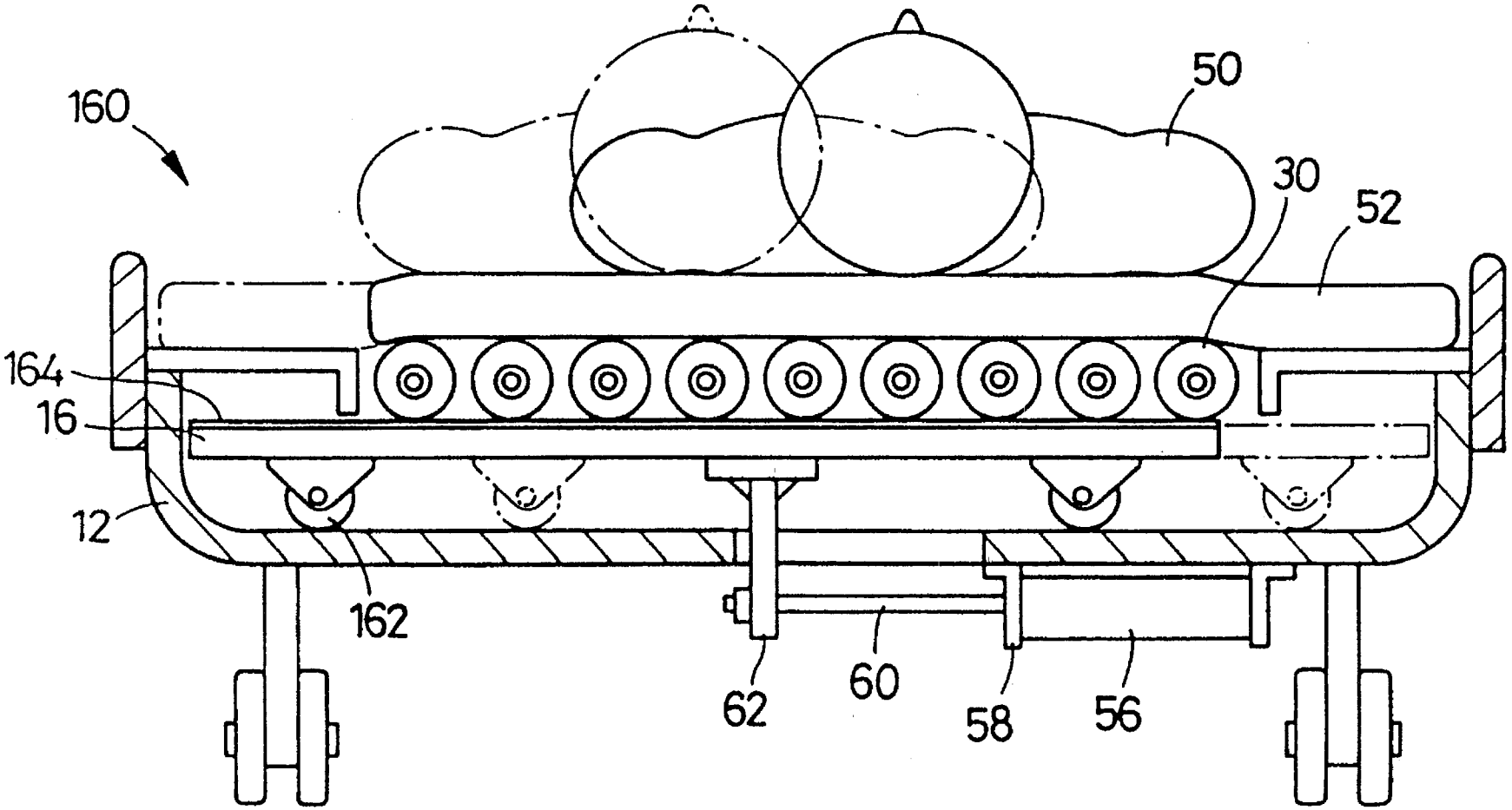
FIGS. 18 and 19 are views corresponding to those of FIGS. 6 and 4, respectively, illustrating a fifth embodiment of the invention.
Figure 19:
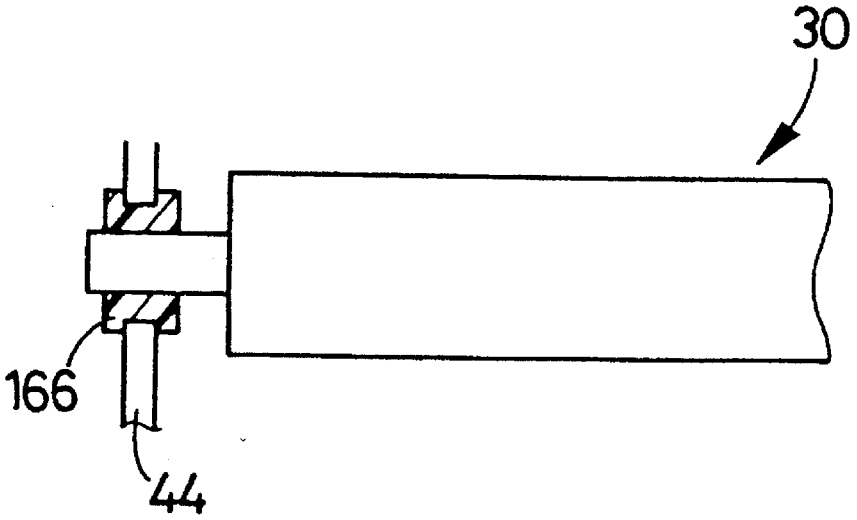

Referring next to FIGS. 18 and 19, there will be described a bed 160 constructed according to a fifth embodiment of this invention. In FIG. 18 which is a view corresponding to FIG. 6, the main frame 12 has a rectangular box structure having a bottom wall, and the movable frame 16 has a plurality of wheels 162 rotatable about their axes parallel to the longitudinal direction of the bed 160. The wheels 162 roll on the inner surface of the bottom wall of the main frame 12, for facilitating the movement of the movable frame 16 by the rolling cylinder 56 from the position indicated in solid line to the position indicated in one-dot chain line. The upper surface of the movable frame 16 is covered by a friction layer 164 which is formed by painting, unlike the friction layer 28 which is bonded to the metal sheet 26. In the present fifth embodiment, resin bushings 166 are used in place of the bearings 40. The resin bushings 166 may be formed of a fluorine-containing resin or a polyamide resin. The present embodiment permits simpler and less expensive arrangements for movably supporting the movable frame 16.

While the present invention has been described above in detail in its presently preferred embodiments with a certain degree of particularity, by way of illustration only, it is to be understood that the invention is not limited to the details of the illustrated embodiments, but may be embodied otherwise.

In the illustrated embodiments, the rolls 30 are supported by the movable frame 16 such that the rolls 30 are vertically movable in sliding contact with the vertical guide members 44 through the bearings 40. However, the rolls 30 may be supported directly by the main frame 12 such that the rolls 30 are rotatable about their axes and directly bear the weights of the living body 50 and the mat 52. In this case, the rolls 30 are operatively connected to each other through suitable power transmitting means such as a chain, and are driven by suitable drive means such as an electric motor. According to this modified arrangement, back-up rolls may be disposed for rolling contact with the rolls 30 when the rolls 30 are deflected downward due to the load acting thereon.

While the center sleeve 32 of each roll 30 used in the second embodiment of FIGS. 9–12 is a metal tubing, a plastic tubing may be used in place of the metal sleeve 32. Similarly, the cylindrical outer elastic portion 34 which is formed of a soft elastic material in the second embodiment may consist of a multiplicity of rings which are formed of other materials such as plastics, wood and metal and are arranged side by side in the axial direction of the center sleeve 32.

While the third embodiment of FIG. 16 uses the stationary and movable racks 130, 132 and the pinions 136 engaging these racks 130, 132, these racks and pinions may be replaced by stationary and movable elongate friction members and friction rolls held in pressing contact with the elongate friction members. In this case, the friction rolls serve as means for operatively connecting the movable frame 16 and the vertical guide members 44.

The pinions 136 and the friction rolls indicated above may be replaced by a synchronous motor adapted to move the vertical guide members 44 in the horizontal direction in synchronization with the movement of the movable frame 16.

Although the raiser mechanism 68 is not provided in the third embodiment of FIG. 16, the raiser mechanism 68 may be provided. In this case, the pivot member 70 is supported by the bearings 82 such that the pivot member 70 is movable in the axial direction of the support shafts 76.

For reducing a shock upon activation of the rolling cylinder 56, a suitable shock absorber such as a rubber or spring damper may be interposed between the piston rod 60 and the bracket 62.

It is to be understood that the present invention may be embodied with various other changes, modifications and improvements, which may occur to those skilled in the art, without departing from the spirit and scope of the invention defined in the following claims.

What is claimed is:

1. A bed having a mat on which a patient lies, comprising:

a main frame;

an array of cylindrical support members supported by said main frame such that said support members are spaced apart from each other at a predetermined spacing interval in a transverse direction of the bed and such that said support members are rotatable about axes thereof, said mat being placed on said array of cylindrical support members; and drive means for rotating said cylindrical support members in rolling contact with said mat, for changing areas of contact of said mat with said support members to thereby change areas of contact of the patient with said mat and promoting blood circulation in a portion of the patient in contact with said mat wherein said cylindrical support members have enough flexibility to prevent deflection thereof, said bed further comprising:

engaging means supported by said frame, for engaging with opposite end portions of each of said cylindrical support members; and a movable frame supported by said main frame such that said movable frame is movable in said transverse direction and is held in contact with at least an intermediate portion of each of said cylindrical support members to thereby support the patient and said mat, each of said cylindrical support members being deflected due to the flexibility thereof at said intermediate portion in a horizontal plane when said movable frame is moved in said transverse direction by said drive means, such that said mat is deflected in said horizontal plane.

2. A bed according to claim 1, which comprises:

vertical guide members supported by said main frame and engaging said cylindrical support members such that said support members are rotatable about their axes and are vertically movable while being guided by said vertical guide members; and a movable frame supported by main frame such that said movable frame is movable in said transverse direction and is held in contact with an underside portion of said array of cylindrical support members to thereby support the patient and said mat, and wherein said drive means including said means for reciprocating said movable frame in said traverse direction at a predetermined operating interval.

3. A bed according to claim 2, which comprises:

transverse guide members supported by said main frame, said guide members guiding said vertical guide members in said transverse direction; and connecting means for operatively connecting said vertical guide members and said movable frame such that said vertical guide members are moved by a distance smaller than a distance of movement of said movable frame by said drive means.

4. A bed according to claim 1, wherein each of said cylindrical support members includes a cylindrical outer elastic portion, and said engaging means comprises vertical guide members supported by said main frame and engaging said opposite end portions of each of said cylindrical support members such that said support members are rotatable and are vertically movable while being guided by said vertical guide members.

5. A bed according to claim 4, which comprises:

transverse guide members supported by said main frame and guiding said vertical guide members in said transverse direction; and connecting means for operatively connecting said vertical guide members and said movable frame such that said vertical guide members are moved by a distance smaller than a distance of movement of said movable frame by said drive means.

6. A bed according to claim 2, wherein said drive means comprises a hydraulic cylinder having a piston rod connected to said movable frame.

7. A bed according to claim 6, which comprises a power source activating said hydraulic cylinder.

8. A bed according to claim 7, wherein said power source includes a hydraulic pump providing a pressurized fluid controlling said hydraulic cylinder.

9. A bed according to claim 7, wherein said power source includes an electric motor activating said hydraulic cylinder.

10. A bed according to claim 2, wherein said movable frame has an upper surface covered by a friction layer which is held in contact with said cylindrical support members.

11. A bed having a mat on which a patient lies, comprising:

a main frame;

an array of cylindrical support members supported by said main frame such that said support members are spaced apart from each other at a predetermined spacing interval in a transverse direction and such that said support members are rotatable about axes thereof, said mat being placed on said array of cylindrical support members; and a drive member rotating said cylindrical support members in rolling contact with said mat and changing areas of contact of said mat with said support members to thereby change areas of contact of the patient with said mat and promoting blood circulation in a portion of the patient in contact with said mat;

wherein said cylindrical support members have enough flexibility to prevent deflection thereof, said bed further comprising:

an engaging member supported by said main frame and engaging with opposite end portions of each of said cylindrical support members; and a movable frame supported by said main frame such that said movable frame is movable in said transverse direction and is held in contact with at least an intermediate portion of each of said cylindrical support members to thereby support the patient and said mat, each of said cylindrical support members being deflected due to the flexibility thereof at said intermediate portion in a horizontal plane when said movable frame is moved in said transverse direction by said drive member, such that said mat is deflected in said horizontal plane.

12. A bed according to claim 11, which comprises:

vertical guide members supported by said main frame and engaging said cylindrical support members such that said support members are rotatable about their axes and are vertically movable while being guided by said vertical guide members; and a movable frame supported by said main frame such that said movable frame is movable in said transverse direction and is held in contact with an underside portion of said array of cylindrical support members to thereby support the patient and said mat, and wherein said drive member includes a mechanism reciprocating said movable frame in said transverse direction at a predetermined operating interval.

13. A bed according to claim 12, wherein said drive member comprises a hydraulic cylinder having a piston rod connected to said movable frame.

14. A bed according to claim 13, which comprises a power source activating said hydraulic cylinder.

15. A bed according to claim 14, wherein said power source includes an electric motor activating said hydraulic cylinder.

16. A bed according to claim 15, wherein said power source includes a hydraulic pump providing a pressurized fluid controlling said hydraulic cylinder.

17. A bed according to claim 12, wherein said movable frame has an upper surface covered by a friction layer which is held in contact with said cylindrical support members.

18. A bed according to claim 12, which comprises:

transverse guide members supported by said main frame, said guide members guiding said vertical guide members in said transverse direction; and a connector operatively connecting said vertical guide members and said movable frame such that said vertical guide members are moved by a distance smaller than a distance of movement of said movable frame by said drive member.

19. A bed according to claim 11, wherein each of said cylindrical support members includes a cylindrical outer elastic portion, and said engaging member comprises vertical guide members supported by said main frame and engaging said opposite end portions of each of said cylindrical support members such that said support members are rotatable and are vertically movable while being guided by said vertical guide members.

20. A bed according to claim 19, which comprises:

transverse guide members supported by said main frame and guiding said vertical members in said transverse direction; and a connector operatively connecting said vertical guide members and said movable frame such that said vertical guide members are moved by a distance smaller than a distance of movement of said movable frame by said drive member.

21. A bed having a mat on which a patient lies, comprising:

a main frame;

an array of cylindrical support members supported by said main frame such that said support members are spaced apart from each other at a predetermined spacing interval in a transverse direction of the bed and such that said support members are rotatable about axes thereof, said mat being placed on said array of cylindrical support members; and drive means for rotating said cylindrical support members in rolling contact with said mat, for changing areas of contact of said mat with said support members to thereby change areas of contact of said living body with said mat for promoting blood circulation in a portion of the patient in contact with said mat wherein said cylindrical support members are arranged so as to extend in a longitudinal direction of the bed normal to said transverse direction, said bed further comprising a raiser mechanism which comprises:

a pivot member supported by said main frame pivotally about a pivot axis parallel to said transverse direction, at a predetermined position in said longitudinal direction, said pivot member including a plurality of parallel beams which are connected to each other and which extend in said longitudinal direction, said parallel beams being shorter than said support members, each of said parallel beams being interposed between corresponding adjacent ones of said support members when said pivot member is placed in a horizontal position; and means for pivoting said pivot member for adjusting an angle of inclination of said pivot member.

22. A bed having a mat on which a patient lies, comprising:

a main frame;

an array of cylindrical support members supported by said main frame such that said support members are spaced apart from each other at a predetermined spacing interval in a transverse direction of the bed and such that said support members are rotatable about axes thereof, said mat being placed on said array of cylindrical support members; and a drive member rotating said cylindrical support members in rolling contact with said mat and changing areas of contact of said mat with said support members to thereby change areas of contact of the patient with said mat and promoting blood circulation in a portion of the patient in contact with the mat;

wherein said cylindrical support members are arranged so as to extend in a longitudinal direction of the bed normal to said transverse direction, said bed further comprising a riser mechanism which comprises:

a pivot member supported by said main frame pivotally about a pivot axis parallel to said transverse direction, at a predetermined position in said longitudinal direction, said pivot member including a plurality of parallel beams which are connected to each other and which extend in said longitudinal direction, said parallel beams being shorter than said support beams, each of said parallel beams being interposed between corresponding adjacent ones of said support members when said pivot member is placed in a horizontal position; and a pivot mechanism pivoting said pivot member and adjusting an angle of inclination of said pivot member.

* * * * *